US006790472B2

(12) United States Patent
Rebar et al.

(10) Patent No.: US 6,790,472 B2
(45) Date of Patent: Sep. 14, 2004

(54) METHOD FOR FILMING CRT LUMINESCENT SCREEN

(75) Inventors: Victoria Ann Rebar, York, PA (US); Bhanumurthy Venkatrama Subrahmanya Gunturi, Lancaster, PA (US)

(73) Assignee: Thomson Licensing S. A., Boulogne-Billancourt (FR)

( * ) Notice: Subject to any disclaimer, the term of this patent is extended or adjusted under 35 U.S.C. 154(b) by 170 days.

(21) Appl. No.: 10/027,889

(22) Filed: Oct. 25, 2001

(65) Prior Publication Data

US 2003/0082295 A1 May 1, 2003

(51) Int. Cl.[7] ..... B05D 1/04; B05D 3/02; B05D 5/06; B05D 5/12; B05D 7/26

(52) U.S. Cl. ..... 427/8; 427/9; 427/10; 427/64; 427/68; 427/470; 427/475; 427/476; 427/483; 427/485; 427/486

(58) Field of Search ..... 427/64, 68, 8, 427/9, 10, 470, 475, 476, 483, 485, 486; 313/466

(56) References Cited

U.S. PATENT DOCUMENTS

| | | | | | |
|---|---|---|---|---|---|
| 3,582,390 | A | * | 6/1971 | Saulnier | 427/69 |
| 3,821,009 | A | * | 6/1974 | Lerner et al. | 427/64 |
| 5,083,959 | A | | 1/1992 | Datta et al. | 445/52 |
| 5,370,952 | A | | 12/1994 | Datta et al. | 430/28 |
| 5,401,977 | A | | 3/1995 | Schwarz | 250/559 |
| 5,474,866 | A | | 12/1995 | Ritt et al. | 430/23 |
| 5,554,468 | A | | 9/1996 | Datta et al. | 430/28 |
| 5,807,435 | A | | 9/1998 | Poliniak et al. | 118/504 |

* cited by examiner

*Primary Examiner*—Michael Cleveland
(74) *Attorney, Agent, or Firm*—Joseph S. Tripoli; Carlos M. Herrera; Richard LaPeruta, Jr.

(57) ABSTRACT

A method of filming a luminescent screen is disclosed which improves the light output of CRTs that contain printed phosphor lines. The method incorporates both the application and film formulation requirements and optionally includes in-line diagnostic techniques. The novel film formulation contains a lacquer and solvents, wherein one of the solvents is a non-solvent for the lacquer. The optional diagnostic technique include surface gloss measurements to characterize and monitor the process and provide predictive capability of CRT performance with respect to light output.

14 Claims, 4 Drawing Sheets

METHOD FOR FILMING CRT LUMINESCENT SCREEN

FIELD OF THE INVENTION

The invention relates to a color cathode-ray tube (CRT) and, more particularly to a color CRT including a luminescent screen assembly.

BACKGROUND TO INVENTION

Lacquer filming is an important process in the manufacture and operational performance of a cathode-ray tube (CRT) because the surface character of the lacquer film dictates the quality of the aluminum film, thereby having an impact on CRT light output. The lacquer film should be smooth and continuous, otherwise perceptible discolorations and brightness non-uniformities could be observed during CRT operation.

When the lacquer film is smooth and continuous, the aluminum will likewise be smooth and continuous, enhancing light output and visual uniformity in an operating CRT. During operation, electrons must penetrate through the aluminum and the aluminum must reflect any phosphorescence toward the viewer.

During manufacturing, the aluminum film must also behave as a semi-permeable membrane. Essentially the aluminum film must allow gaseous species to pass therethrough during the screen bake process, a necessary thermal process employed to remove remnant organic materials from the screening process. These species must pass through the aluminum without causing the aluminum film to bubble, peal or blister. Typically CRT manufacturers will apply microscopic crystals of boric acid or ammonium oxalate to the lacquer film substrate prior to aluminizing the screen, thereby creating microscopic perforations in the aluminum film. These perforations permit the gases to diffuse through the aluminum film while allowing the aluminum film to retain light-reflecting character.

One means of applying thin films onto the interior surface of panel of a CRT is an electrostatic spray technique. U.S. Pat. No. 5,807,435, issued on Sep. 15, 1998, describes such a technique. This has been an efficacious method of filming a CRT luminescent screen having phosphor stripes printed using an electrophotographic screen process (EPS). An EPS process has been described in U.S. Pat. No. 5,474,866, issued on Dec. 12, 1995, wherein a layer of a suitable organic photoconductor (OPC) is applied to a layer of an organic conductor (OC) on the interior of a panel followed by: suitably charging OPC; selectively discharging appropriate areas of the OPC by irradiating the OPC with light through a shadow mask positioned within the panel; removing the mask and depositing triboelectrically charged phosphor of a color to form the first color element for the CRT; and repeating the charging, exposing and depositing steps for each of the remaining two colors.

The phosphor stripes are then fixed after the EPS process to prevent the phosphor particles from substantially moving during the filming process. Simultaneous fixing of the three color phosphor stripes is achieved by applying a gentle electrostatic spray of a solvent or solvents onto the panel, wherein the OPC is dissolved and encapsulates the phosphor particles. As the solvent molecules evaporate, the phosphor particles become effectively anchored (or often referred to as fixed).

Prior to the deposition of film lacquer by electrostatic spraying or spin coating, the fixed phosphor substrate is rough and discontinuous. With the proper application of the lacquer film onto the fixed screen, the resultant substrate, at the air-lacquer interface, is smooth and continuous; consequently, the aluminum, which is vacuum evaporated onto the lacquer film, is smooth and continuous. The panel assembly is later screen baked to remove the organic materials; hence, the panel is ready for tube finishing.

Two risks associated with the lacquer film are the potential for the aluminizing layer on top of the lacquer film to blister during the screen bake process, if the mass of the organic materials is too high, and the potential for the light output of the CRT to be too low because of the roughness of the aluminum surface. Rough aluminum occurs if the lacquer film is too low in screen weight or the lacquer film is not smooth and continuous. The challenge is to employ lacquer film formulations which can reduce the risk of aluminum blistering and yet allow the aluminum film to be smooth and continuous such that the light output is enhanced.

SUMMARY OF THE INVENTION

The present invention relates to the manufacture of a cathode-ray tube having deposits of phosphor powder on the interior of a glass panel, wherein a novel film formulation is applied to the deposits of phosphor to form a filmed surface followed by the application of a thin layer of aluminum on the filmed surface and the exposure of the glass panel to a sufficiently high temperature to volatilize the organic components. The novel filming formulation has at least one lacquer material and at least two solvents, wherein one of the solvents has poor solvating power for at least one lacquer material.

BRIEF DESCRIPTION OF THE DRAWINGS

A detailed description of invention will follow with relation to the accompanying figures in which.

DETAILED DESCRIPTION OF THE PREFERRED EMBODIMENT

Figure 1:
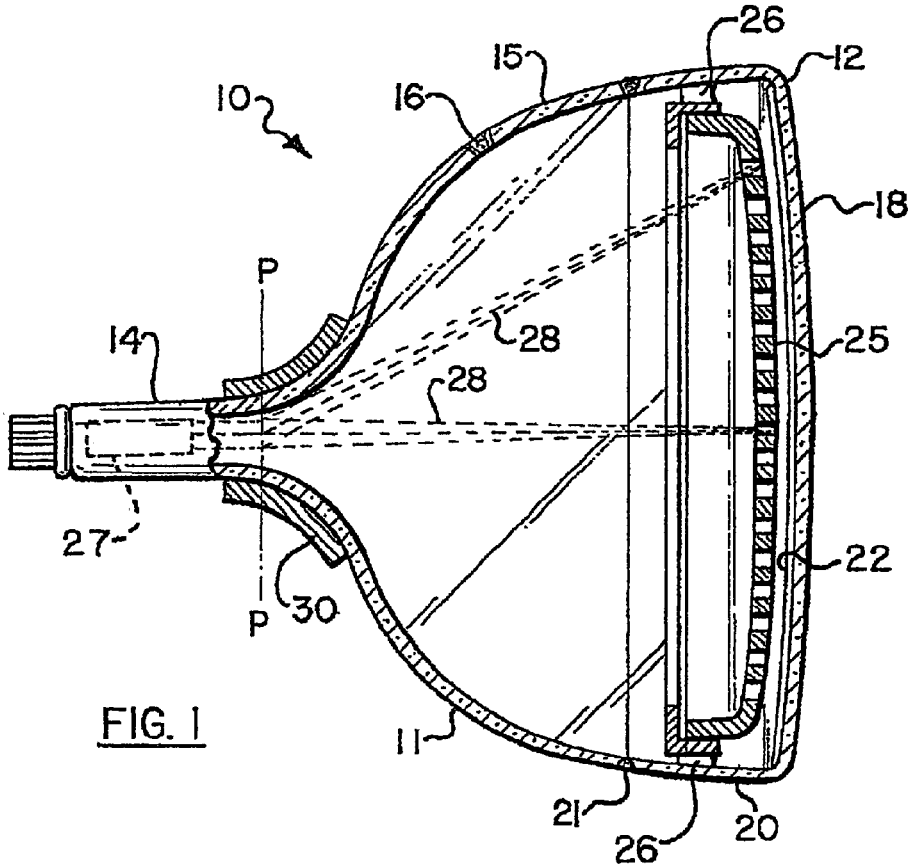
FIG. 1 is a cross sectional side view of a color CRT having a luminescent screen.

The invention, which is a new method of manufacturing a CRT, produces CRTs having improved light output. The method specifically relates to an improved filming process for screens of CRTs processed with electrophotographically printed phosphor elements. FIG. 1 shows such a color CRT 10 which has a glass envelope 11 comprising a rectangular panel 12 and a tubular neck 14 connected by a rectangular funnel 15. The funnel 15 has an internal conductive coating (not shown) that contacts an anode button 16 and extends into the neck 14. The panel 12 comprises a faceplate 18 and a peripheral flange or sidewall 20, which is sealed to the funnel 15 by a glass frit 21. A luminescent three color phosphor screen 22 is carried on the inner surface of the faceplate 18.

Figure 2:
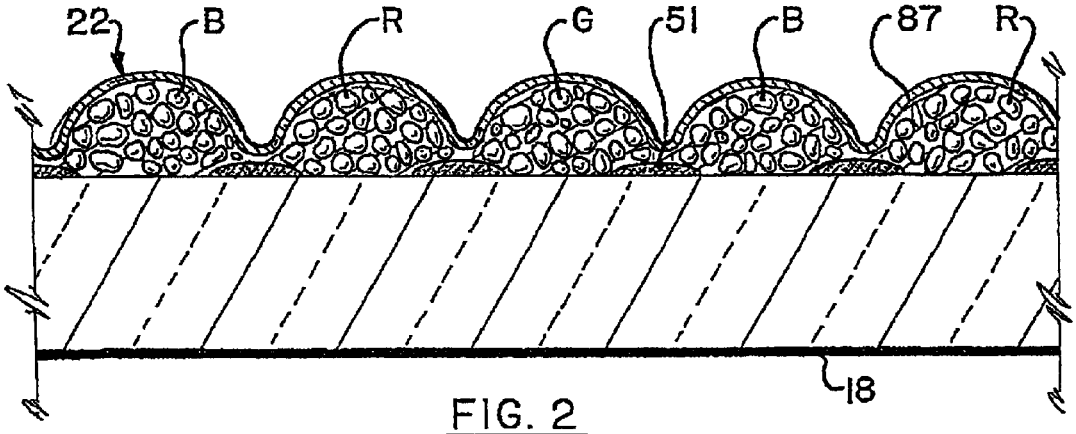
FIG. 2 is a cross sectional side view of a panel of the CRT of FIG. 1, showing a finished screen assembly.

The screen 22, shown in FIG. 2 is a line screen which includes a multiplicity of screen elements comprised of red-emitting, green-emitting, and blue-emitting phosphor stripes R, G, and B, respectively, arranged in color groups or picture elements of three stripes or triads, in a cyclic order. The stripes extend in a direction that is generally normal to the plane in which the electron beams 28 are generated. In the normal viewing position of the embodiment of FIG. 1, the stripes extend in the vertical direction. Portions of each phosphor stripe overlay on a thin, light absorptive matrix 51, shown in FIGS. 2, 4, and 5. The invention also pertains to CRTs 10 having screens 22 with dot structure. A thin conductive layer 87, preferably of aluminum, overlies the screen 22 and provides a means for applying a uniform potential to the screen 22 during tube operation, as well as for reflecting light, emitted from the phosphor elements, through the faceplate 18. The screen 22 and the overlying aluminum layer 87 comprise a screen assembly. A shadow mask 25 is removably mounted in predetermined spaced relation to the screen assembly, using a plurality of studs 26 affixed to the sidewall 20.

An electron gun 27 shown schematically by the dashed lines in FIG. 1 is centrally mounted within the neck 14, to generate and direct three electron beams 28 along convergent paths, through the apertures of the mask 25, to the screen 22. The CRT 10 also includes an external magnetic deflection yoke 30 to properly direct the beams 28 to the screen 22.

Figure 4:
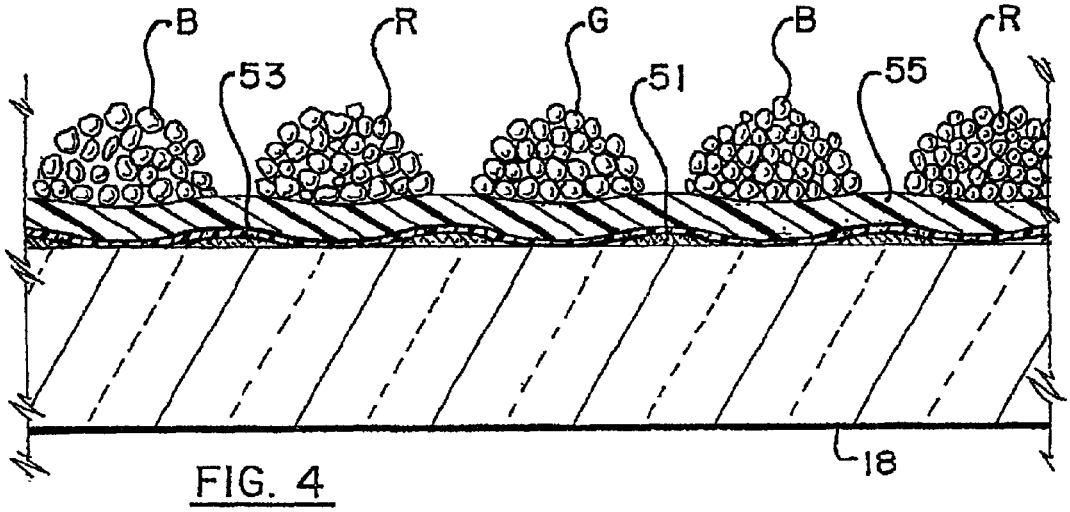
FIG. 4 is a cross sectional plain view of a faceplate of the CRT of FIG. 1, showing a screen assembly before the fixing process with the dry phosphor lines deposited.
Figure 5:
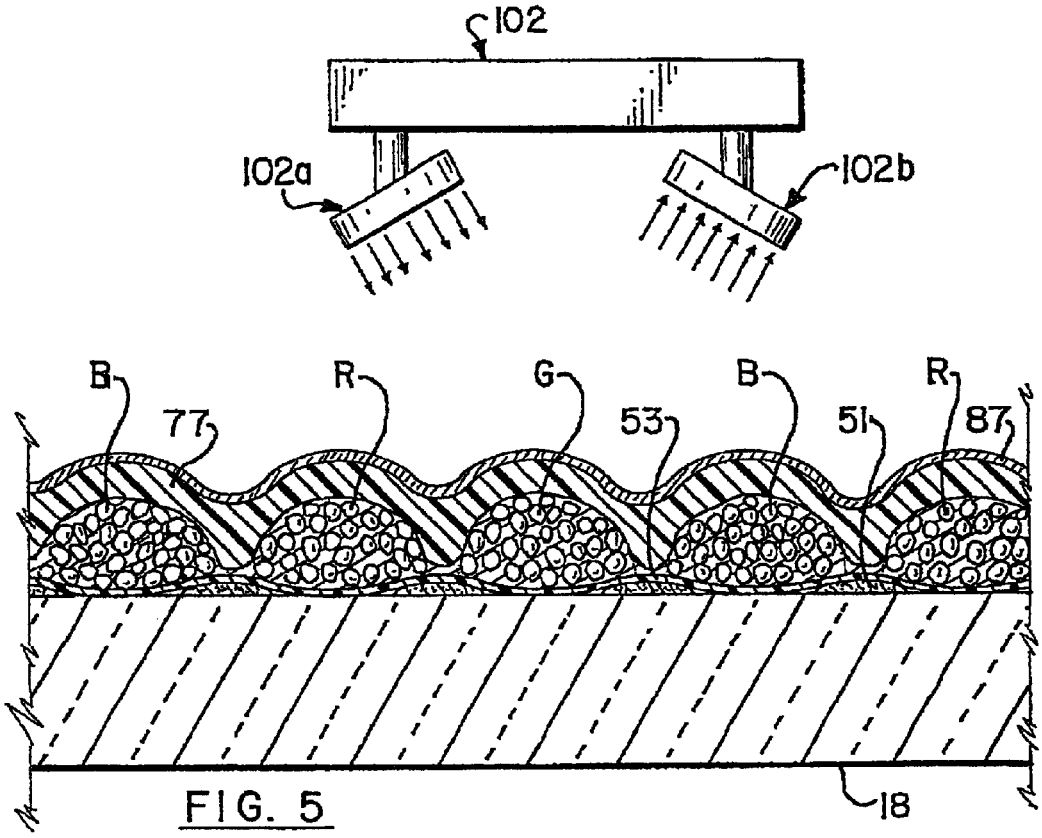
FIG. 5 is a cross sectional plain view of the screen assembly, as characterized by a gloss meter according to the invention.
Figure 6:
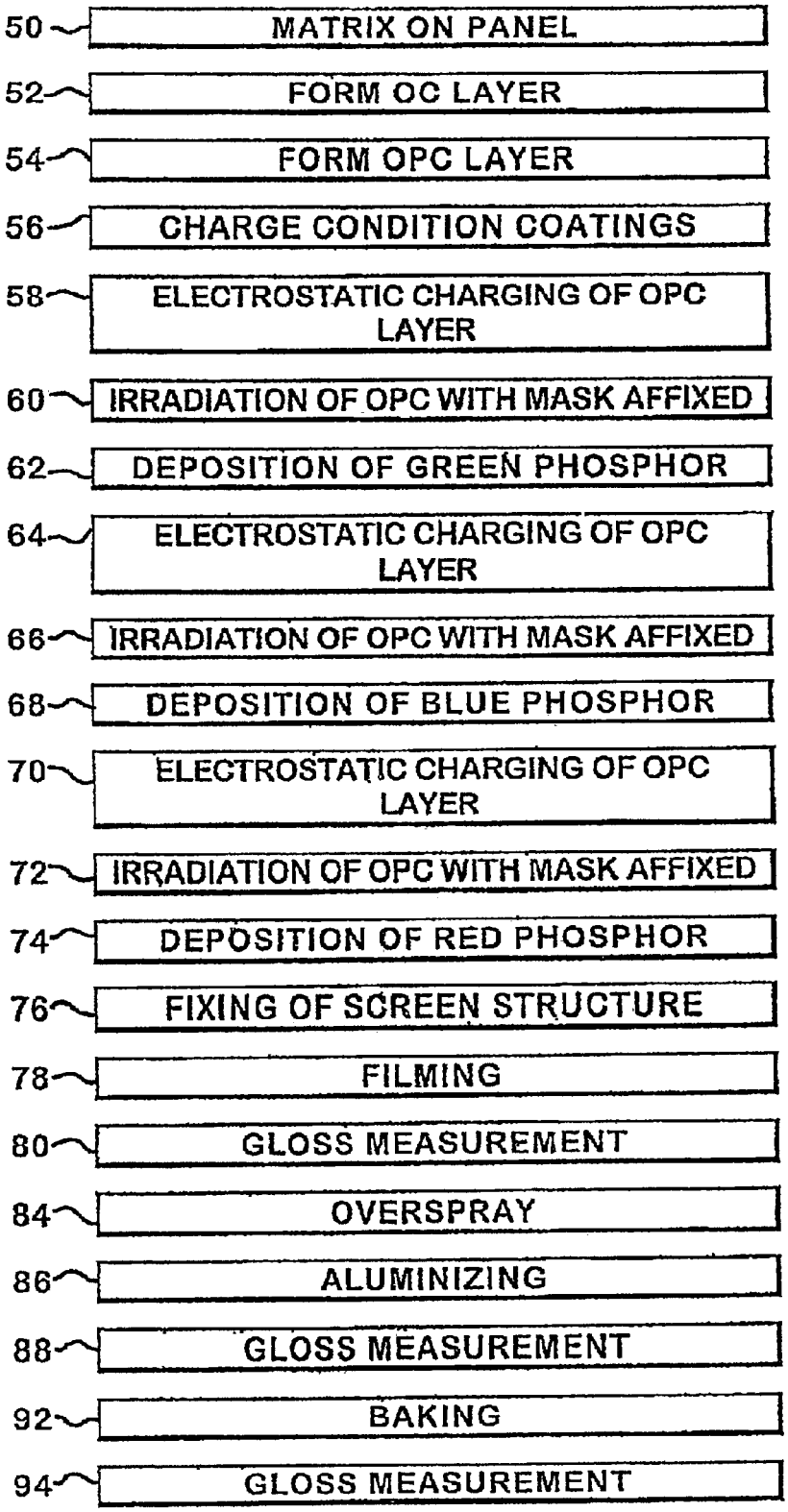
FIG. 6 is a process flow chart.

The screen 22 is manufactured using a series of process steps in FIG. 6. The matrix process 50 is performed prior to the EPS processes. The matrix process 50 can be performed with photoresist processes known in the art. The three phosphor stripes red R, green G, and Blue B in FIGS. 2, 4, and 5 are then printed onto the matrixed panel using a electrophotographic screening (EPS) process. One EPS process has been described in U.S. Pat. No. 5,554,468. FIG. 6 includes the EPS process steps which print the phosphor stripes. (Steps 52 to 74 print the stripes).

Figure 3:
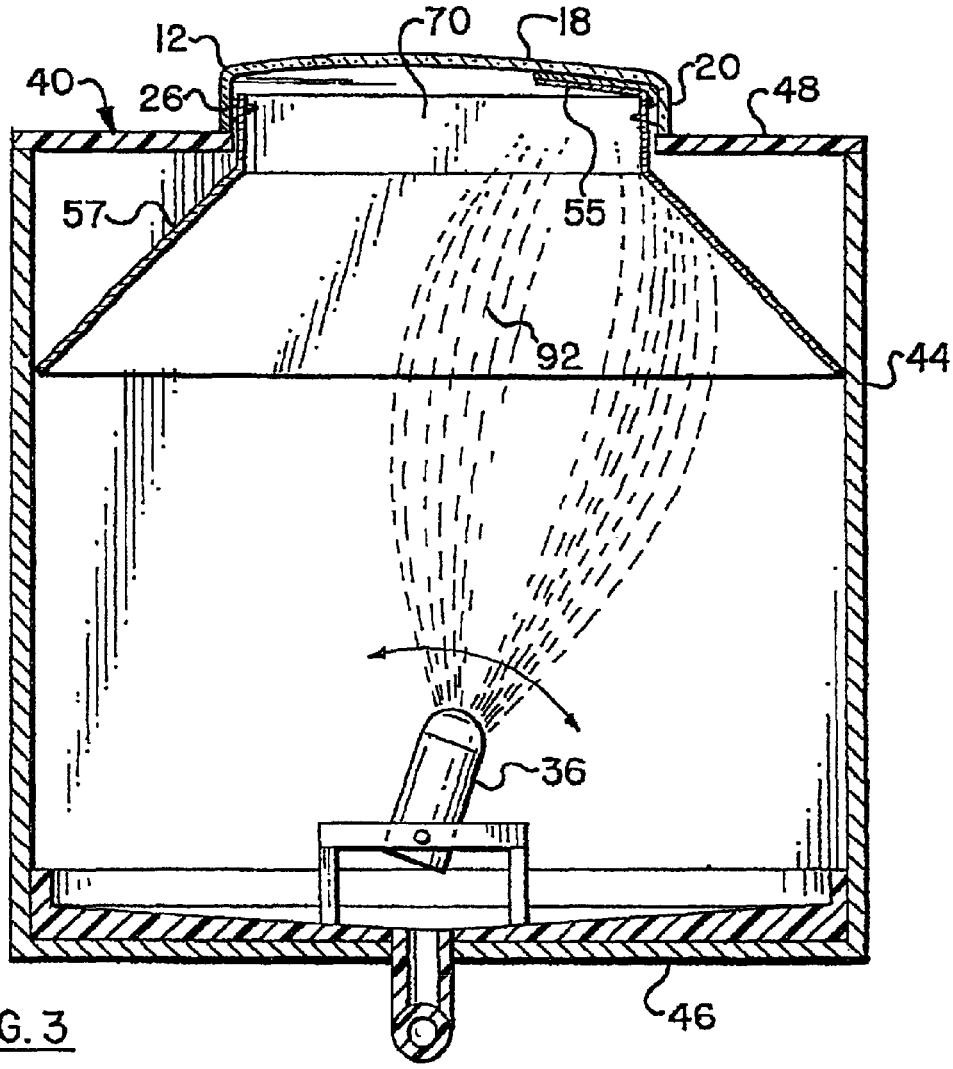
FIG. 3 is a cross sectional side view of the electrostatic spray module 40 of the types used for applying the OPC layer and the lacquer film layer according to the present invention.

In general the EPS process is initiated by the application of the OC layer 53 in FIG. 4, wherein the OC layer 53 is about 1 micron in thickness. Suitable OC formulations for EPS processes have been described in U.S. Pat. No. 5,370,952. The OPC layer, which is about 6 microns in thickness, can be applied with an electrostatic spray module. The electrostatic spray module 40 shown in FIG. 3 has at least one AEROBELL™ electrostatic spray gun 36, internal shielding 57, a bottom 46, walls 44, and a top 48. An OPC formulation can consist of a polystyrene polymer resin which is the bulk of the solids and the following other materials: an electron donor 1,4-di(2,4 methylphenyl)-1,4 diphylbutatriene; electron acceptor materials such as 2,4,7-trinotro-9-fluorenone and 2-ethylanthrquinone; a surfactant such as U-7602 available from Union Carbide; a plasticizer dioctylphthalate; and a mixture of solvents such as toluene and xylene. A method for applying the OPC layer 55 has been described in U.S. Pat. No. 5,807,435. The phosphor lines are then printed using a technique such as that described in U.S. Pat. No. 5,083,959: the printing onto the OPC layer 55 generally involves steps 60 to 74 outlined in FIG. 6. Once the phosphors are on the OPC layer 55, the screen 22 is then fixed in step 76, by contacting the phosphor lines with a suitable fixative such as methylisobutylketone, to secure the phosphors to the OPC layer 55. The process can likewise utilize an electrostatic spray module 40.

Filming EPS screens usually involves applying a polymethylmethacrylate (PMMA) lacquer film layer 77, which is shown in FIG. 5, over the fixed phosphor using an electrostatic spray module 40. The solids content of the film formulation is 7–10% in methylisobutylketone (MIBK), wherein MIBK has the following characteristics: molecular weight of 100; boiling point of 116° C.; the MIBK is a solvent for PMMA; and the MIBK evaporates in 10–15 min thereby forming film layer 77. Filming of the EPS screens can also be performed by spin coating.

The invention incorporates a new filming formulation, wherein at least one solvent has poor solvating power for the polymer in the film formulation and is less volatile than at least another solvent in the formulation. Hereafter the solvent with the poor solvating power will be referred to as a nonsolvent. This use of such a solvent has resulted in increased light output in tubes. The formulation utilizes the following components: the methyl isobutyl ketone (MIBK), the linalyl acetate (LA), and polymethylmethacrylate (PMMA). PMMA is dissolved in the MIBK and LA solvents resulting in a stable mixture. In the preferred embodiment a solution contains MIBK at 81.0%, LA at 4.0%, and PMMA at 15% by weight, wherein LA has the following characteristics: molecular weight of 196; boiling point of 220° C.; less volatile than MIBK; LA is not a solvent for PMMA; LA and MIBK together dissolve PMMA.

Prior to aluminizing in step 86 in FIG. 6, microcrystals of boric acid, ammonium oxalate, or oxalic acid can be applied to the film layer 77. After aluminizing, the screen 22 is screen baked up to about 450° C. in step 92 to drive off the volatilizable constituents of the screen assembly, wherein the screen assembly is typically held above 425° C. for about 30 minutes.

The table below demonstrates the improvement observed in CRTs having an EPS screen made with this method (i.e., with linalyl acetate) versus a control. Solids contents in the film formulations were 15% by weight in this example.

| Linalyl Acetate | White Light Output |
|---|---|
| 0% | 24.6 Lumens/Watt |
| 4% | 28.5 Lumens/Watt |

Figure 7:
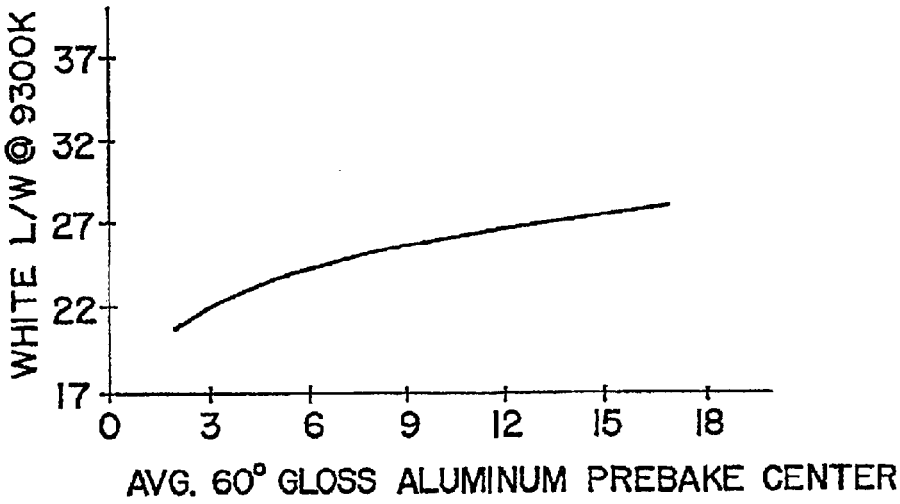
FIG. 7 is light output data at the center of a luminescent screen as a function of aluminum film gloss measurements for a sample CRT.

This invention also incorporates a diagnostic technique to characterize and monitor the process and provide predictive capability to tube operating performance regarding tube brightness. One diagnostic technique involves the use of a gloss measurement after aluminizing the filmed assembly to characterize the quality of the film and aluminum surfaces. A gloss measurement technique substantially conforming to the US Standard ASTM D 523 or US Standard ASTM D 2457 at 600 can be used. A representation of a gloss measurement is shown in FIG. 5, wherein the gloss meter 102 has a light output component 102*a* and a light detection component 102*b*. Example data for a 20 inch (20V) cathode-ray tube at the center of the luminescent screen 22 is represented in FIG. 7, wherein values of gloss are in gloss units. A CRT manufacturer can use curves such as in FIG. 7 to preferentially select threshold values for tube performance predictability or quality control purposes.

The method increases smoothness and uniformity of the screen 22, thereby improving light output. Additionally, the improved lacquer film formulation of the method reduces the propensity for the aluminum to blister during the screen bake process step 92.

What is claimed is:

1. A method of manufacturing a luminescent screen for cathode-ray tubes having deposits of phosphor powder on an interior of a faceplate comprises:

applying a film formulation over said deposits to form a lacquer film, said film formulation comprising polymethylmethacrylate (PMMA), methyl isobutyl ketone (MIBK), and linalyl acetate (LA);

applying a thin layer of aluminum on said film; and exposing said screen to a sufficiently high temperature to volatilize any organic components.

2. The method of claim 1, wherein said film formulation is applied by electrostatic spraying.

3. The method of claim 1, wherein said film formulation is applied by spin coating.

4. The method of claim 1, wherein at least one type of miorocrystals, which is selected from the group of boric acid, ammonium oxalate, or oxalic acid, is applied to said film prior to applying a layer of aluminum onto said film.

5. A method of manufacturing a luminescent screen for cathode-ray tubes having fixed phosphor elements that comprises:

electrostatically spraying a film formulation on to said fixed phosphor elements resulting in a lacquer film, wherein said formulation comprises polymethylmethacrylate (PMMA), methyl isobutyl ketone (MIBK), and linalyl acetate (LA);

applying a thin layer of aluminum on said film; and exposing said screen to a sufficiently high temperature to volatilize any organic components.

6. The method of claim 5, wherein said film formulation comprises concentrations of 81.0% wt. MIBK, 4.0% wt. LA, and 15.0% wt. PMMA.

7. The method of claim 5, wherein said fixed phosphor elements are stripes.

8. The method of claim 5, wherein said fixed phosphor elements are dots.

9. A method of manufacturing a luminescent screen, for a cathode-ray tube having electrophotographically printed phosphor elements on a panel, that comprises:

fixing said phosphor elements by applying a suitable fixative with electrostatic spray of a solvent or solvents onto the panel, whereby a OPC, which is under said phosphor elements, is dissolved and encapsulates individual phosphor particles resulting in fixed phosphor elements;

applying a film formulation over said fixed phosphor elements to form a lacquer film, wherein said film formulation contains methyl isobutyl ketone (MIBK), linalyl acetate (LA), and polymethylmethacrylate (PMMA);

applying a thin layer of aluminum on said film; and exposing said screen to about 450° C. to volatilize all of the organic components.

10. The method of claim 9, wherein said film formulation comprises concentration ranges of 79 to 93% wt. of MIBK, 2 to 6% wt. of LA, and 5 to 15% wt. of PMMA.

11. The method of claim 9, wherein said fixed phosphor elements are in the form of stripes.

12. The method of claim 9, wherein said fixed phosphor elements are in the form of dots.

13. A method of manufacturing a plurality of luminescent screens, for cathode-ray tubes having electrophotographically printed phosphor elements, that comprises:

fixing said phosphor elements by applying a suitable fixative with electrostatic spray of a solvent or solvents onto individual panels, whereby a OPC, which is under said phosphor elements, is dissolved and encapsulates individual phosphor particles resulting in fixed phosphor elements;

applying a film formulation over said fixed phosphor elements to form a lacquer film, wherein said film formulation contains methyl isobutyl ketone (MIBK), linalyl acetate (LA), and polymethylmethacrylate (PMMA);

applying a thin layer of aluminum on said film;

measuring gloss of said thin layer aluminum on individual panels before exposing said screens on said panels to about 450° C.;

evaluating values of gloss such that panels having said thin layer aluminum exceeding a threshold figure will be further processed and those not meeting said figure are scrapped; and exposing said screens of those panels having said thin layer aluminum exceeding said threshold figure to about 450° C. to volatilize all of the organic components.

14. A method of manufacturing a plurality of luminescent screens, for cathode-ray tubes having electrophotographically printed phosphor elements, that comprises:

fixing said phosphor elements by applying a suitable fixative with electrostatic spray of a solvent or solvents onto individual panels, whereby a OPC, which is under said phosphor elements, is dissolved and encapsulated individual phosphor particles resulting in fixed phosphor elements;

applying a film formulation over said fixed phosphor elements to form a lacquer film, wherein said film formulation contains methyl isobutyl ketone (MIBK), linalyl acetate (LA), and polymethylmethacrylate (PMMA);

applying a thin layer of aluminum on said film;

exposing said screens to about 450° C. to volatilize all of the organic components;

measuring gloss of said thin layer aluminum on individual panels;

evaluating values of gloss such that panels having said thin layer aluminum exceeding a threshold figure wilt be further processed an those not meeting said figure are scrapped.

* * * * *